US005978487A

United States Patent [19]

Kusaba

[11] Patent Number: 5,978,487

[45] Date of Patent: Nov. 2, 1999

[54] SPECTRUM DISPLAYING DEVICE FOR AUDIO DEVICE

[75] Inventor: Katsumi Kusaba, Kyoto, Japan

[73] Assignee: Rohm Co., Ltd., Kyoto, Japan

[21] Appl. No.: 08/763,794

[22] Filed: Dec. 11, 1996

[30] Foreign Application Priority Data

Dec. 13, 1995 [JP] Japan ..... 7-346680

[51] Int. Cl.[6] ..... H04R 29/00

[52] U.S. Cl. ..... 381/56; 381/58; 324/76.31

[58] Field of Search ..... 381/58, 109, 119, 381/56; 324/76.31, 76.45, 76.68, 76.29, 76.41, 76.44, 76.46; 345/134, 133, 140

[56] References Cited

U.S. PATENT DOCUMENTS 4,307,340 12/1981 Inami et al. ..... 381/58
5,614,860 3/1997 Osaki et al. ..... 327/552
5,619,340 4/1997 Inagaki ..... 386/99

OTHER PUBLICATIONS

Mitchell et al, Introduction to Electronics Design, pp. 524–526, 1988.

*Primary Examiner*—Ping W Lee
*Attorney, Agent, or Firm*—Fay,Sharpe,Beall, Fagan,Minnich & McKee

[57] ABSTRACT

A spectrum display device for audio use includes a first differential amplifier circuit and a first capacitor forming a low pass filter. A second differential amplifier circuit and a second capacitor form high pass filter; A band pass filter circuit is formed by the low pass filter and the high pass filter; A band selection circuit selectively sets a frequency band of the band pass filter circuit out of a plurality of predetermined frequency bands through selective setting of the operating currents of the first and second differential amplifier circuits.

5 Claims, 2 Drawing Sheets

SPECTRUM DISPLAYING DEVICE FOR AUDIO DEVICE

BACKGROUND OF THE INVENTION

The present invention relates to a spectrum displaying device for an audio device and, more specifically, relates to a spectrum displaying device for an audio device in which transconductance amplifiers, so called variable Gm amplifiers, constituted by differential amplifiers and capacitors are combined to form an active differentiation circuit and an active integration circuit and a band pass filter (BPF) is constituted by the active differentiation and integration circuits for use as a graphic equalizer display circuit, and which enables reduction in the circuit scale thereof.

BACKGROUND ART

A graphic equalizer is generally provided for component stereo systems, mini or micro component stereo systems, radio cassette recorders and karaoke audio devices. Such graphic equalizes use a display such as a LED and a LCD (Liquid Crystal Display) in order to visualize powers of every frequency band in input signals and displays signal levels corresponding to the respective frequency components in the input signals.

A display speed of the display in such graphic equalizers can be slow in view of human visual sensitivity, therefore, even in a case of a display with multiple elements of five or more display elements, a control can be employed in which the display elements are changed over in a time sharing manner and signal levels in the respective divided frequency bands are successively selected one by one and are displayed. Further, some of such display control circuits even permit time sharing change-over control in which the display elements including those for right and left channels of stereo signals are changed over.

A graphic equalizer which performs such time sharing change-over control includes a plurality of BPFs and detectors of a number corresponding to the number of display elements for the frequency components (bands) to be analyzed. In the display, respective detection signals obtained respectively from the plurality of BPFs are received, the respective detection signals are further detected with the detectors at the side of the display and the levels of the respective detection signals are applied to the corresponding display elements or display electrodes which are selected in a time sharing manner to thereby perform the required display.

In such graphic equalizers having a plurality of BPFs of a number corresponding to the number of display elements, many types of internal circuits are structured into an IC and each of the BPFs is normally constituted by a low pass filter which is formed by an active differentiation circuit composed by combining a differential amplifier and a capacitor and a feed back circuit, and a high pass filter which is formed of an active integration circuit composed by the similar combination and a feed back circuit. Through the employment of such constitution, the major circuit part of the BPFs is structured into an IC.

FIG. 2 shows an example of conventional graphic equalizers (a spectrum display device) 30 in which audio signals are received by an input buffer 31, the received audio signals are input to respective band pass filters BPF1 through BPFn each allotted to one of the frequency bands determined by dividing the audio frequency into n parts and the signal levels of the respective frequency bands are detected by detectors DET1 through DETn provided for the respective BPFs, each composed of a detector circuit including a diode and a capacitor, and are transmitted to a multiplexer 32. The multiplexer 32 successively selects the detector signals from the detectors DET1 through DETn in a time sharing manner in response to the time sharing displaying and outputs the selected signals via an output buffer 33 to a display circuit 34.

A decoder 35 receives a selection signal of a frequency band allotted to one of the BPFs from a micro controller (MCU) 36 (or from a computer (MPU)), decodes the same as a terminal selection signal (a change-over signal) at the multiplexer 32 and outputs the decoded signal to the multiplexer 32. Further, the decoded signal is transmitted to the display circuit 34 and is used there as a signal for selecting a display block of the selected frequency band for performing the time sharing displaying. Thereby, in alignment with the timing of the detection signal which is input into the display circuit 34 in synchronism with the change-over of the multiplexer 32, the display blocks are selected in a time sharing manner and the levels of the detection signals corresponding to the respective frequency bands are displayed at the respective selected display blocks. Further, each of the display blocks normally includes a group of display elements or a group of display electrodes in order to display the levels of the detection signals.

However, in these graphic equalizers there arises a problem that as of the number of display blocks increases, normally called the number of display elements, which display the audio frequency bands in a divided manner, in other words, depending on an increase of the divided number of the audio frequency, the number of the BPFs and the detectors increases and the circuit scale therefor is accordingly enlarged. Thereby, it becomes difficult to structure the circuit including these circuit portions into a one chip IC, the production cost thereof increases. Further it also becomes difficult to mount such circuit on a small size and thin device, and moreover the power consumption thereby is also increased.

SUMMARY OF THE INVENTION

An object of the present invention is to resolve the above mentioned conventional problems and to provide a spectrum display device which permits the circuits scale thereof to be reduced.

Another object of the present invention is to provide an audio device having a graphic equalizer which permits the circuit scale thereof to be reduced.

A spectrum display device for audio use and an audio device having the same according to the present invention which achieves the above objects is constituted by a first differential amplifier circuit and a first capacitor forming a low pass filter, a second differential amplifier circuit and a second capacitor forming a high pass filter, a band pass filter circuit formed by the low pass filter and the high pass filter, and a band selection circuit which selectively sets a band of the band pass filter circuit out of a plurality of predetermined bands through selective setting of operating currents of the first and second differential amplifier circuits.

More specifically, the present invention is provided with a first active filter which is formed by a first differential amplifier circuit connected to a first current source setting an operation current and a first capacitor, a second active filter which is formed by a second differential amplifier circuit connected to a second current source setting an operation current and a second capacitor, a band pass filter circuit formed by the first active filter and the second active filter, frequency bands of the band pass filter circuit being set through the setting of the operation currents of the first and second differential amplifier circuits and depending on these operation currents, a constant current source circuit including a plurality of first constant current sources provided as the first current source and a plurality of second constant current sources provided as the second current source which are designed to selectively set a frequency band of the band pass filter circuit out of a plurality of predetermined bands, a multiplexer which selects one of a plurality of the first constant current sources and one of a plurality of the second constant current sources in response to a selection signal selecting one of a plurality of the frequency bands to thereby set the operating currents of the first and second differential amplifier circuits, a detection circuit which receives the output from the band pass filter circuit and detects the signal level of the received output, and a display circuit which receives the output of the detection circuit and displays the signal level of the received output as a signal level in a predetermined frequency band of the input signal.

As will be seen from the above, a band pass filter circuit is constituted by high pass and low pass active filters each constituted by a capacitor and a differential amplifier circuit, and through selective setting of the operating current of the respective differential amplifier circuits by the frequency band selecting circuit one of the frequency bands of the band pass filter circuit is selected. The frequency band selecting circuit is, for example, constituted by a plurality of the constant current sources. The multiplexer and the multiplexer performs the change-over in response to the selection signal generated in correspondence with the time sharing displaying of the display blocks by the display circuit and selects one of a plurality of constant current sources. The current value of the selected constant current source by the multiplexer at this moment corresponds to the operating current through which the band pass filter circuit establishes the frequency band to be selected.

Accordingly, without requiring a plurality of band pass filters, band pass filters of predetermined frequency bands having respective center frequencies are successively formed in a time sharing manner in correspondence with the time sharing displaying so that detection signals of the input signal for the respective frequency bands are obtained.

As a result, the spectrum display device according to the present invention requires only one BPF and one detector to thereby limit the circuit scale thereof. Further, the spectrum display device according to the present invention is suitable for reducing the size and thickness thereof and in correspondence with the scale limitation of the BPF and detector (DET) part the power consumption thereby is also reduced. The reduction of the power consumption through the scale limitation of the BPF and detector part according to the present invention is larger than the increase of the power consumption caused by the constant current sources which are provided for determining the respective frequency bands, because the circuit scale of the constant current sources is smaller than that of the band pass filter circuit formed by the high pass and low pass active filters. Accordingly, an audio device having a graphic display of limited power consumption, of which circuit portion including the BPF and the detector is easily structured into one chip IC and which is suitable for reducing the size and thickness thereof, is realized.

BREIF DESCRIPTION OF THE DRAWINGS

FIG. 1 is a block diagram of one embodiment of a spectrum display device to which the present invention is applied; and FIG. 2 is a block diagram of a conventional spectrum display device.

DETAILED DESCRIPTION OF THE PREFERRED EMBODIMENT

Figure 1:
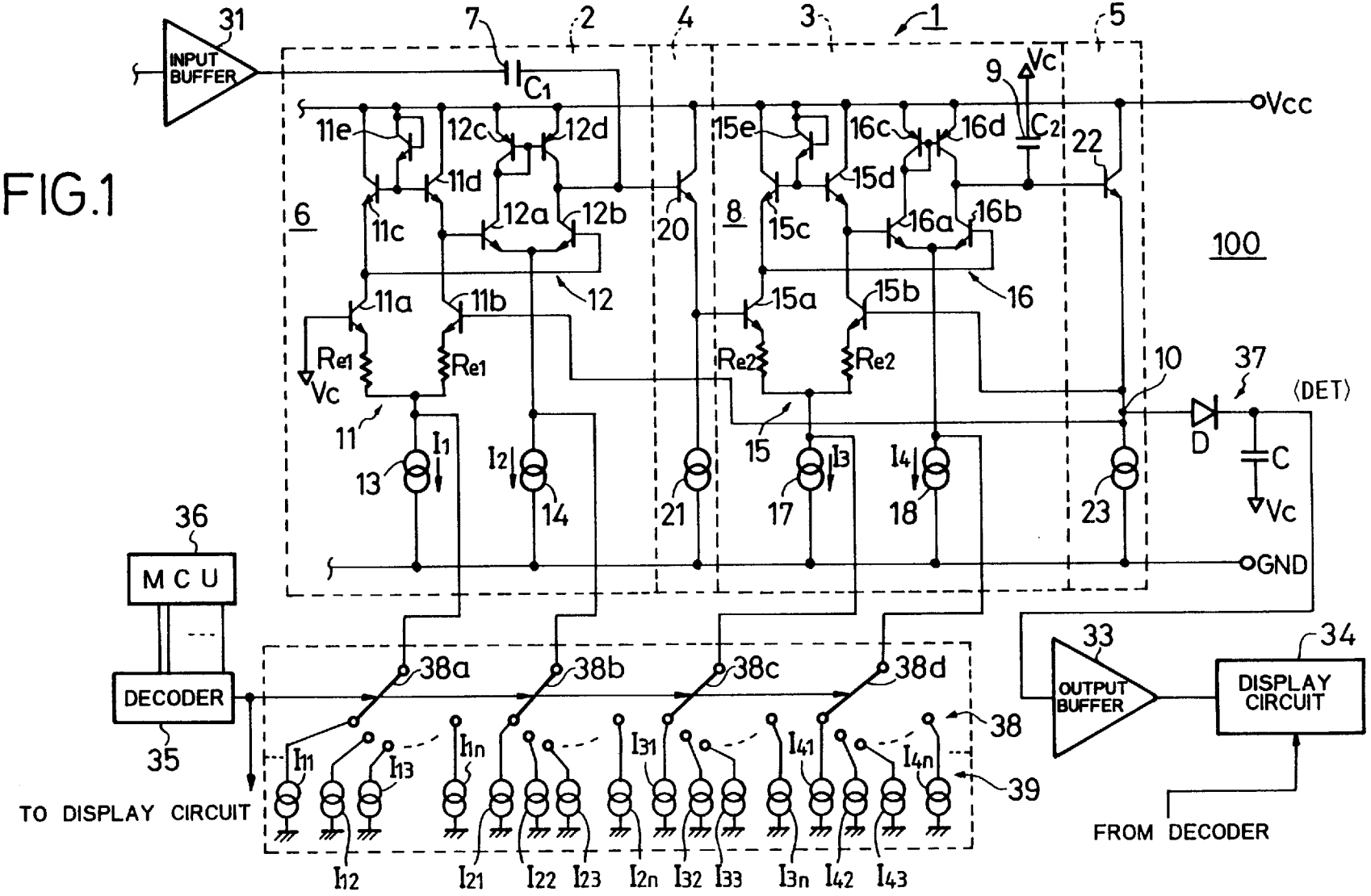

In FIG. 1 numeral 100 is a spectrum display device, such as a graphic equalizer, which includes a frequency band variable BPF circuit 1, a detector (DET) 37, a multiplexer circuit 38 having multiplexers 38*a* through 38*d* and a constant current source circuit 39. The constant current source circuit 39 includes constant current sources $I_{11}$ through $I_{1n}$, constant current sources $I_{21}$ through $I_{2n}$, constant current sources $I_{31}$ through $I_{3n}$ and constant current sources $I_{41}$ through $I_{4n}$ corresponding to the respective multi-prexers 38*a* through 38*d*. In FIG. 1, the same elements as in FIG. 2 are designated by the same reference numbers.

The respective multiplexers 38*a* through 38*d* receive selection signals from the decoder 35 and successively select their terminals, more specifically, every time when a selection signal is received, at first the constant current sources $I_{11}$, $I_{21}$ , $I_{31}$ and $I_{41}$ are selected at the same time, and thereafter the constant current sources $I_{12}$, $I_{22}$, $I_{32}$ and $I_{42}$ are selected at the same time. In this way respective corresponding constant current sources are successively selected in parallel and finally the constant current sources $I_{1n}$, $I_{2n}$, $I_{3n}$ and $I_{4n}$ are selected at the same time. Then the operation returns to the first selection of the constant current sources $I_{11}$, $I_{21}$, $I_{31}$ and $I_{41}$. Further, the selection signals in the present embodiment serve as signals which select in a time sharing manner the display blocks in the display circuit 34.

The DET 37 is a detection circuit constituted by a diode D for detection use and a capacitor C, and one terminal of the capacitor C is connected to a bias line Vc.

Figure 2:
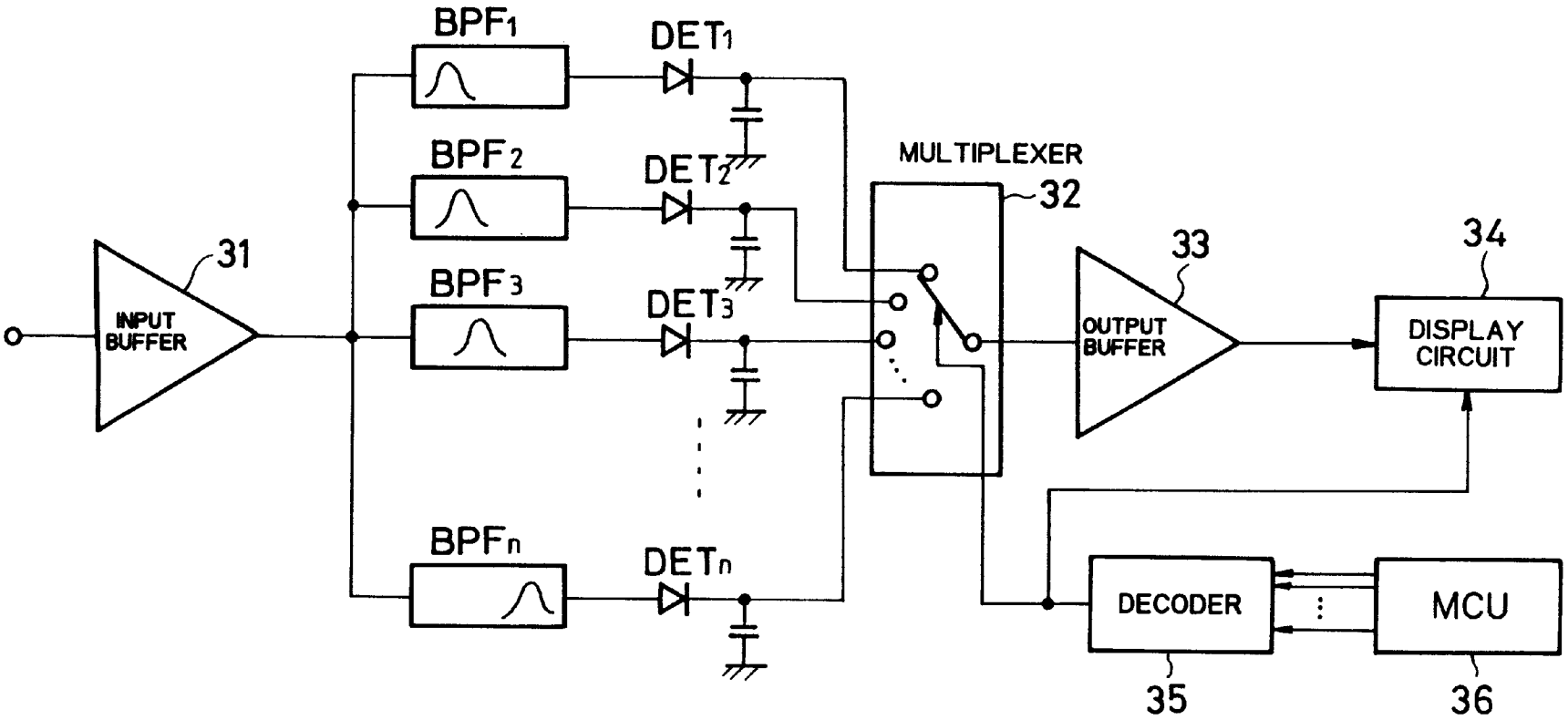

The display circuit 34 is substantially the same as that shown in FIG. 2 and in which the respective frequency bands determined by dividing the audio frequency into n pieces are allotted to respective display blocks each consisting of by a display element group or a display electrode group and when the decode signals (selection signals for selecting a frequency band in the BPF) are received from the decoder 35, the levels of the detection signals are displayed in a time sharing manner at the display blocks corresponding to the respective selected bands.

The frequency band variable BPF circuit 1 is constituted by an active differentiation circuit 2, an active integration circuit 3, a buffer amplifier 4 disposed between the active differentiation circuit 2 and the active integration circuit 3 and another buffer circuit 5 provided for the connection with the subsequent stage and for feed back operation.

The active differentiation circuit 2 is constituted by a variable Gm differential amplifier circuit 6 composed of differential amplifiers 11 and 12 in two stage connection and a capacitor 7 for differential use. One terminal of the capacitor 7 is connected to the output side of the differential amplifier circuit 6 and the other terminal thereof is connected to the output side of the input buffer 31. The active differentiation circuit 2 receives input signals from the input buffer 31 via the capacitor 7 and outputs the same to the buffer amplifier 4 and the time constant thereof is determined by the capcitance C1 of the capacitor 7 and the output impedance of the differential amplifier circuit 6.

The active integration circuit 3 is constituted by a variable Gm differential amplifier circuit 8 composed of differential amplifiers 15 and 16 in two stage connection and a capacitor 9 for integration use. One terminal of the capacitor 9 is connected to the output side of the differential amplifier circuit 8 and the other terminal thereof is connected in AC sense to the grounding line GND via the bias line. The active integration circuit 3 receives input signals from the buffer amplifier 4 and the time constant thereof is determined by the capcitance C2 of the capacitor 9 and the output impedance of the differential amplifier circuit 8.

The output of the integration circuit 8 is outputted to the DET 37 via the buffer amplifier 5 and the output terminal 10 and further, the output is also fed back via the output terminal 10 to the input of the differentiation circuit 2 (to the base of a transistor 11*b*). Thereby, the voltage of the capacitor 7 at the differentiation side (the votage at the output side) is fed back to the input of the differential amplifier 11 in the differential amplifier circuit 6 to constitute the active differentiation circuit. Similarly, the voltage of the capacitor 9 in the integration circuit 8 (the voltage at the output side) is fed back via a transistor 22 and the output terminal 10 to the input of the differential amplifier 15 (the base of a transistor 15*a*) to thereby constitute the active integration circuit.

The differential amplifier circuit 6 in the differentiation circuit 2 and the differential amplifier circuit 8 in the integration circuit 3 respectively constitute voltage-current conversion circuits and the circuit structures thereof are substantially the same. Therefore, the structure of the differential amplifier circuit 6 is hereinbelow explained in detail and an explanation of the structure of the differential amplifier circuit 8 is omitted.

The differential amplifier circuit 6 is constituted by the differential amplifier 11 and the differential amplifier 12 which receives at the inputs thereof the respective differential outputs of the differential amplifier 11.

The differential amplifier 11 includes N type (NPN) bi-polar transistors 11*a* and 11*b*, N type bi-polar transistors 11*c* and 11*d* which are inserted as active loads to the respective collector sides of the N type bi-polar transistors 11*a* and 11*b* and an N type bi-polar transistor 11*e* in diode connection which is connected in common to the bases of the active load N type transistors 11*c* and 11*d*, and the bases of the N type transistors 11*c* and 11*d* are connected to each other and the collectors thereof are connected to the power source line +Vcc. Further, at the respective emitter sides of the N type transistors 11*a* and 11*b* resistors Re1 and Re1 are inserted and a current source 13 having a current value $I_1$ is provided with one terminal connected in common with these resistors Re1 and Re1 and the other terminal thereof connected to the grounding line GND. The base of the transistor 11*a* is connected to the bias line Vc and the base of the transistor 11*b* receives the fed back signal from the output terminal 10.

The differential amplifier 12 includes N type bi-polar transistors 12*a* and 12*b* and P type (PNP) bi-polar transistors 12*c* (in diode connection) and 12*d* in current mirror connection which are connected to the respective collector sides of the N type bi-polar transistors 12*a* and 12*b* as the loads and of which emitters are respectively connected to the power source line +Vcc. The emitters of the N type transistors 12*a* and 12*b* are connected to each other and a current source 14 having a current value $I_2$ that is, current source 14 has one terminal connected in common to the mutually connected emitters of the transistors 12*a* and 12*b* and another terminal which is connected to the grounding line GND. The collector of the transistor 12*b* operates as the output of the differential amplifier 12 and is connected to the base of the N type bi-polar transistor 20 in the buffer amplifier 4 and to the capacitor 7.

In the thus constituted differential amplifier circuit 6, the current values $I_1$ and $I_2$ of the current sources 13 and 14 determine the ratio of the change-over currents for the respective differential amplifiers 11 and 12 and the gain Gm thereof is substantially given according to the following equation:

$$Gm=I_2/I_1\times Re1$$

wherein Re1 is the resistance value of the resistor Re1.

The above explanation is similarly applied to the differential amplifier circuit 8 and the differential amplifier 15 in the differential amplifier circuit 8 corresponds to the differential amplifier 11 in the differential amplifier circuit 6 and the differential amplifier 16 in the differential amplifier circuit 8 corresponds to the differential amplifier 12 in the differential amplifier circuit 6. Further, transistors 15*a* through 15*e* constituting the differential amplifier 15 respectively correspond to the transistors 11*a* through 11*e*, and transistors 16*a* through 16*e* constituting the differential amplifier 16 respectively correspond to the transistors 12*a* through 12*e*. Still further, an emitter resistor Re2 in the differential amplifier 15 corresponds to the emitter resistor Re1. The current value of a current source 17 in the differential amplifier circuit 8 which corresponds to the current source 13 is $I_3$ and the current value of a current source 18 in the differential amplifier circuit 8 which corresponds to the current source 14 is $I_4$.

The structures of the buffer amplifiers 4 and 5 are also substantially the same. The buffer amplifier 4 is disposed between the power source line Vcc and the grounding line GND and is constituted by the transistor 20 of which the collector is connected to the power source line Vcc and a constant current source 21. One terminal of constant current source 21 is connected to the emitter of the transistor 20 and the other terminal is connected to the grounding line GND. The buffer amplifier 5 is also disposed between the power source line Vcc and the grounding line GND and is constituted by an N type bi-polar transistor 22 of which the collector is connected to the power source line Vcc and a constant current source 23, one terminal of which is connected to the emitter of the transistor 22 and the other terminal of which is connected to the grounding line GND.

In the present embodiment, the differentiation circuit 2 and the integration circuit 3 respectively function as a low pass active filter and a high pass active filter and are connected in cascade, and since the output of the integration circuit 3 is fed back to the input of the differentiation circuit 2, thereby the band variable BPF circuit 1 is constituted. In this case, a center frequency $f_0$ of the band variable BPF circuit 1 is given by the following equation:

$$f_0=(1/2\pi)(K1\times K2/Re1\times Re2\times C1\times C2)^{1/2}$$

wherein $K1=I_2/I_1$, $K2=I_4/I_3$ and Re1 and Re2 are respectively the resistance values of the resistors Re1 and Re2.

Therefore, through control of the values $K1=I_2/I_1$ and $K2=I_4/I_3$, the center frequency $f_0$ of the BPF circuit 1 can be freely selected.

For this purpose, the constant current source circuit 39 is constituted by the constant current sources $I_{11}$through $I_{1n}$ which are provided for the current source 13 and one of which is selected to be connected in parallel therewith, the constant current sources $I_{21}$through $I_{1n}$ which are provided for the current source 14 and one of which is selected to be connected in parallel therewith, the constant current sources $I_{31}$ through $I_{3n}$ which are provided for the current source 17 and one of which is selected to be connected in parallel therewith and the constant current sources $I_{41}$ through $I_{4n}$ which are provided for the current source 18 and one of which is selected to be connected in parallel therewith, and ones of the constant current sources in respective groups are successively selected in a time sharing manner by the respective corresponding multiplexers 38*a* through 38*d* in correspondence with the time sharing displaying at the display circuit 34. Through this selection ones of the constant current sources in respective groups for the respective current sources 13, 14, 17 and 18 respectively are connected in parallel, thereby, the operating currents of the differential amplifiers 11 and 12 and the operating currents of the differential amplifiers 15 and 16 are respectively set at predetermined values and one of a plurality of predetermined frequency bands, namely one of the divided frequency bands by n, of the frequency band variable BPF circuit 1 is selected in a time sharing manner in correspondence with the time sharing displaying.

Therefore, the current values of the constant current sources $I_{11}$through $I_{1n}$, the constant current sources $I_{21}$through $I_{2n}$, the constant current sources $I_{31}$ through $I_{3n}$ and the constant current sources $I_{41}$ through $I_{4n}$ are respectively determined so that the frequency band of the frequency band variable BPF circuit 1 corresponds to one for a display block in the display circuit 34 which displays one of the divided audio frequency bands which is set time to time.

Namely, the respective current values of the constant current sources $I_{11}$ through $I_{1n}$, the constant current sources $I_{21}$through $I_{2n}$, the constant current sources $I_{31}$ through $I_{3n}$ and the constant current sources $I_{41}$ through $I_{4n}$ are determined in such a manner that when $I_1$+the current value $I_{11}$of the constant current source $I_{11}$, $I_2$+the current value $I_{21}$of the constant current source $I_{21}$, $I_3$+current value $I_{31}$ of the constant current source $I_{31}$ and $I_4$+the current value $I_{41}$ of the constant current source $I_{41}$ are selected at the same time, the frequency band variable BPF circuit 1 establishes the frequency band corresponding to that of BPF 1 as shown in FIG. 2, and when $I_1$+the current value $I_{12}$ of the constant current source $I_{12}$, $I_2$+the current value $I_{22}$ of the constant current source $I_{22}$, $I_3$+the current value $I_{32}$ of the constant current source $I_{32}$ and $I_4$+the current value $I_{42}$ of the constant current source $I_{42}$ are selected at the time, the frequency band of the frequency band variable BPF circuit 1 corresponds to that of BPF 2 as shown in FIG. 2, in like manner the frequency bands corresponding to those of BPF 3, . . . are successively established and finally when $I_1$+the current value $I_{1n}$ of the constant current source $I_{1n}$, $I_2$+the current value $I_{2n}$ Of the constant current source $I_{2n}$, $I_3$+the current value $I_{3n}$ of the constant current source $I_{3n}$ and $I_4$+the current value $I_{4n}$ of the constant current source $I_{4n}$ are selected at the same time, the frequency band of the frequency band variable BPF 1 establishes one corresponding to that of BPFn as shown in FIG. 2.

Accordingly, the present embodiment permits a spectrum display corresponding to n elements (corresponding to divided frequency bands by n).

As an alternative in the present embodiment, the current sources 13, 14, 17 and 18 can be eliminated and instead the constant current sources $I_{11}$ through $I_{1n}$, the constant current sources $I_{21}$through $I_{2n}$, the constant current sources $I_{31}$ through $I_{3n}$ and the constant current sources $I_{41}$ through $I_{4n}$ can be used directly as the current sources for the respective differential amplifiers 11, 12, 15 and 16.

The differential amplifier circuit as explained in the present embodiment is only one example thereof and any variable Gm amplifier, for example, an operational amplifier can be used therefor. In the present invention such an operational amplifier is included in the scope of the differential amplifier circuit. In principle, when an active differentiation circuit and an active integration circuit are constituted respectively by a capacitor and an amplifier having differential inputs and Gms of the respective amplifiers are varied, their cutoff frequencies can be set so as to establish any frequency bands.

In the present embodiment, the multiplexer receives signals from the decoder and constant current sources in respective groups are successively selected, however, the function of the multiplexer is to successively select constant current sources in the respective groups, it is enough if the multiplexer is designed to receive simple pulse like signals from a decoder. Therefore, the change-over signals are not necessarily decoded at the decoder and can be simple timing signals generated in correspondance with the time sharing displaying at the side of the display circuit.

I claim:

1. A spectrum display device for audio use comprising:

a first active filter which is formed by a first differential amplifier circuit connected to a first current source setting an operation current and a first capacitor;

a second active filter which is formed by a second differential amplifier circuit connected to a second current source setting an operation current and a second capacitor;

a band pass filter circuit formed by said first active filter and said second active filter, frequency bands of said band pass filter circuit being set through setting of the operation currents of said first and second differential amplifier circuits and depending on these operation currents;

a constant current source circuit including a plurality of first constant current sources provided as said first current source and a plurality of second constant current sources provided as said second current source which are designed to selectively set one of the frequency bands of said band pass filter circuit corresponding respectively to a plurality of predetermined frequency bands;

a multiplexer which selects one of said plurality of first constant current sources and one of said plurality of second constant current sources in response to a selection signal selecting one of the plurality of frequency bands and sets the operating currents of said first and second differential amplifier circuits;

a detection circuit which receives the output from said band pass filter circuit and detects the signal level of the received output; and a display circuit which receives the output of said detection circuit and displays the signal level of the received output as a signal level of a predetermined frequency band in input signals;

wherein said plurality of first constant current sources includes a single first constant current source connected to said first differential amplifier circuit and a plurality of third constant current sources and said plurality of second constant current sources includes a single second constant current source connected to said second differential amplifier circuit and a plurality of fourth constant current sources, and said multiplexer includes a first multiplexer which selects one of said plurality of third constant current sources in response to the selection signal and connects the same in parallel with said first constant current source and a second multiplexer which selects one of said Plurality of fourth constant current sources in response to the selection signal and connects the same in parallel with said second constant current source.

2. A spectrum display device for audio use according to claim 4, wherein each of said first and second differential amplifier circuits is constituted by a transconductance amplifier, said first differential amplifier circuit and said first capacitor constitute a differentiation circuit, said second differential amplifier circuit and said second capacitor constitute an integration circuit, said differentiation circuit and said integration circuit are connected in cascade and the output of said integration circuit is fed back to the input side of said differentiation circuit.

3. A spectrum display device for audio use according to claim 2, wherein said detection circuit is constituted by a diode and a capacitor and receives the output of said integration circuit, and said display circuit includes a plurality of display blocks which display levels of the signals detected by said detection circuit in correspondence with said plurality of frequency bands and one of said plurality of display blocks is selected upon receipt of the selection signal.

4. A spectrum display device for audio use according to claim 1, wherein said first differential amplifier circuit includes first and second differential amplifiers, said second differential amplifier circuit includes third and fourth differential amplifiers, said single first constant current source is constituted by two current sources each for said first and second differential amplifiers, said plurality of third constant current sources and said first multiplexer are respectively provided for the respective current sources for said first and second differential amplifiers, and said single second constant current source is constituted by two current sources one a current source for said third differential amplifier and the other a current source for said fourth differential amplifier, and said plurality of fourth constant current sources and said second multiplexer are respectively provided for the respective current sources for said third and fourth differential amplifiers.

5. A sepectrum display device for audio use according to claim 4, wherein the selection signal is a timing signal which selects one of said plurality of display blocks in a time sharing manner.

* * * * *